US005690158A

United States Patent [19]

Bellamy

[11] Patent Number: 5,690,158

[45] Date of Patent: Nov. 25, 1997

[54] DEVICE FOR MAINTAINING STRETCHED A PANEL OF SUPPLE MATERIAL, BY ITS EDGES

[76] Inventor: André Bellamy, 2, Rue De Vaugirard, 92130 Issy-les Moulineaux, France

[21] Appl. No.: 424,533

[22] PCT Filed: Nov. 22, 1993

[86] PCT No.: PCT/FR93/01149

§ 371 Date: Sep. 29, 1995

§ 102(e) Date: Sep. 29, 1995

[87] PCT Pub. No.: WO94/12741

PCT Pub. Date: Jun. 9, 1994

[30] Foreign Application Priority Data

Dec. 1, 1992 [FR] France ..... 92 14462

[51] Int. Cl.[6] ..... A47H 23/00

[52] U.S. Cl. ..... 160/327; 160/391; 52/222

[58] Field of Search ..... 160/327, 328, 160/378, 391; 52/222

[56] References Cited

U.S. PATENT DOCUMENTS

| | | | |
|---|---|---|---|
| 3,833,046 | 9/1974 | Tombu | 160/327 |
| 3,961,661 | 6/1976 | Tombu | 160/328 |
| 4,625,490 | 12/1986 | Baslow | 160/327 X |
| 4,765,039 | 8/1988 | Rowlands et al. | 52/222 X |
| 4,790,037 | 12/1988 | Phillips | 52/222 X |
| 4,817,699 | 4/1989 | Fein . | |
| 4,825,931 | 5/1989 | Fein | 160/327 |
| 4,986,332 | 1/1991 | Lanuza | 52/222 X |
| 5,230,377 | 7/1993 | Berman | 160/327 |
| 5,275,224 | 1/1994 | Morris | 160/327 |

FOREIGN PATENT DOCUMENTS

| | | |
|---|---|---|
| 2109097 | 5/1972 | France . |
| 2444575 | 12/1978 | France . |

*Primary Examiner*—Blair Johnson
*Attorney, Agent, or Firm*—Fisher, Christen & Sabol

[57] ABSTRACT

Device for fixing on a support (2) and stretching by its edges a panel (3) of supple material, of the type comprising a section (6) capable of being fixed on said support (2) and associated with means (19, 20) for blocking the edge of said panel (3) by pinching effect, characterized in that it comprises means (10–15) for removably connecting on said section (6) an element (7) of which the distal end, towards the edge of the panel (3), is provided with said pinching means.

4 Claims, 2 Drawing Sheets

DEVICE FOR MAINTAINING STRETCHED A PANEL OF SUPPLE MATERIAL, BY ITS EDGES

Figure 1:
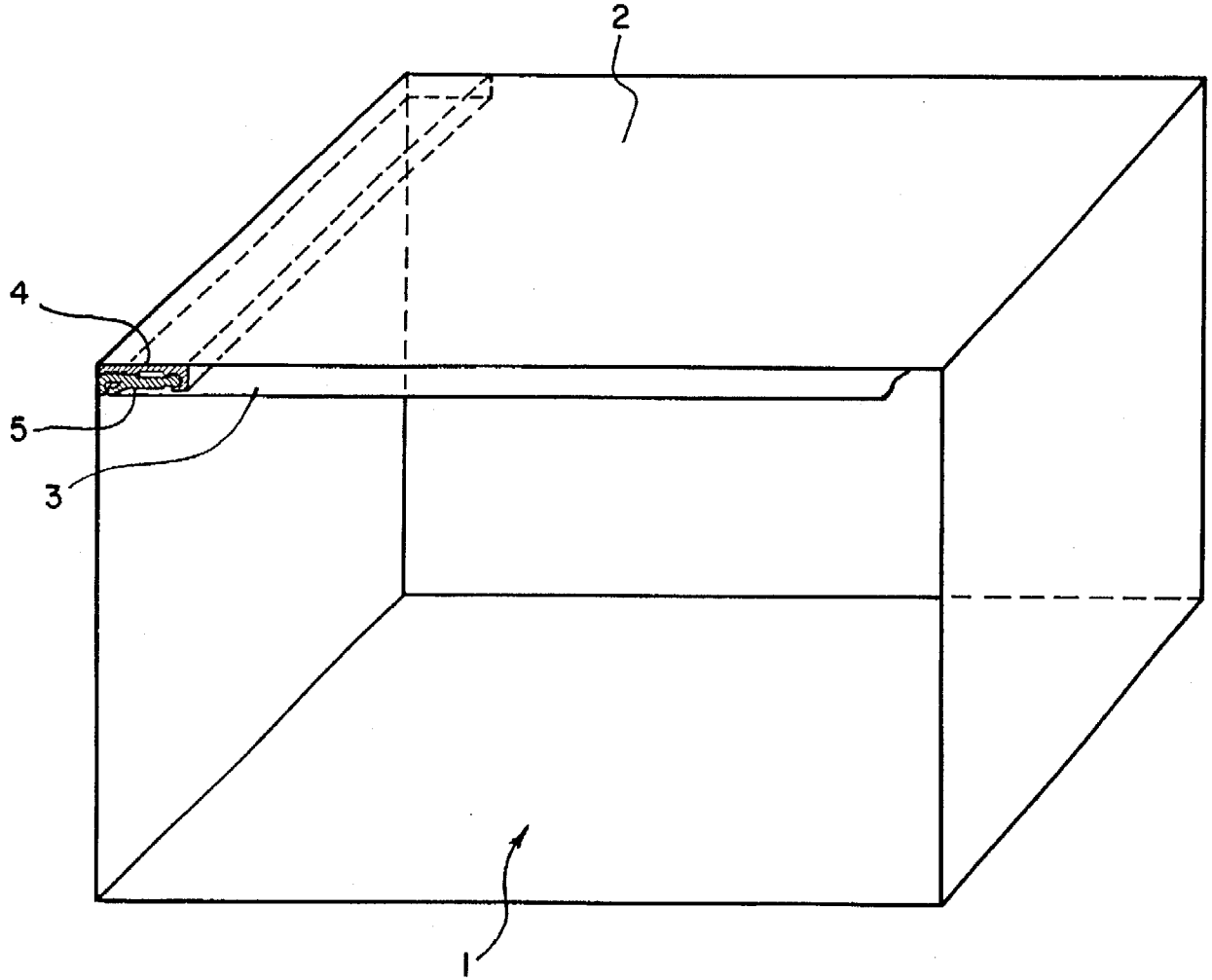

The present invention relates to a device for fixing on a support such as a ceiling or a wall, a panel of supple material such as a PVC film or a cloth, so that the panel is maintained taut by its edges.

The invention is more particularly applicable in the domain of false ceilings, constituted by a sheet of plastics material disposed against the ceiling that is to be covered with a view to concealing the defects thereof. In the domain of renovation of premises, and particularly of dwellings, commercial, professional premises or those for domestic use, it is current practice to dispose at some millimeters of centimeters from the ceiling in place, a sheet of plastics material such as PVC intended to constitute the visible ceiling. This operation is relatively current and aims at avoiding making considerable and expensive renovation work on the ceiling in place, particularly when the original ceiling is considerably degraded.

The sheets of plastic are positioned and maintained stretched (forming a so-called stretched ceiling), by using sections, generally of U-shape, opening towards the original ceiling, one of the vertical branches of the U being fixed on the lateral wall, near the ceiling, and the other vertical branch of the U being of length slightly shorter than the first branch fixed on the wall, so as to allow a passage between the top of the small branch of the U and the ceiling. In this passage is introduced a packing strip rendered fast with the edge of the stretched ceiling. The line of packing is then introduced via said passage inside the U-section and presents sufficient properties of elasticity for it to expand, once in place in the U, and thus block the edge of the stretched ceiling.

This type of known device is relatively simple and may be dismantled even by amateurs. Such dismantling may be necessary, for example in order to restretch the stretched ceiling after a certain time, or to remove the stretched ceiling to replace it by another.

Nonetheless, this known device presents a major drawback, namely its dimensions, both in height and laterally, i.e. in the plane of the ceiling. Such dimensions may go up to 25 millimeters in height and 30 to 35 millimeters in width. In is not possible to reduce the dimensions of the U-section, at the risk of endangering its mechanical integrity. These dimensions are all the more awkward from the aesthetic standpoint as the U-section projects from the stretched ceiling. Apart from the aesthetic aspect, the dimensions of the U-section are problematic insofar as the original ceiling presents mouldings, which reduces the possibilities of positioning a stretched ceiling taking into account the space already taken by the mouldings. Likewise, the presence of a square- or parallelepipedic section of such dimensions (25×35 mm) arranged against mouldings destroys the aesthetic appearance thereof, of which the precise purpose is decorative.

Attempts have been made to overcome this drawback, in known manner, by using a section of quadrangular cross-section, of shape elongated in the plane parallel to the ceiling. The section is fixed to the ceiling is known manner (clipping or gluing) and comprises means for blocking by pinching, such as a lip displaceable between an open position disengaging a housing in which the edge of the panel may be slid, and a closed position where the lip bears on the edge of the opening, pinching the edge of said panel. This device substantially reduces the total dimensions of the device since its height may be reduced to 8 mm. Moreover, the lateral dimensions or depth in the direction of the plane of the ceiling is reduced since the pinching means are disposed at an end of the device disposed towards the edge, i.e. as near as possible to the lateral wall associated with the original ceiling on which the stretched ceiling is added. In this way, from the aesthetic standpoint, the improvement is substantial compared with the known device described hereinbefore.

However, it is possible to dismantle this device only by specialized staff, with increases the cost and difficulty of dismantling, for example for restretching the stretched ceiling or for changing it. So, nowadays, the user is offered only two types of devices, one capable of being dismantled but showing a big visible dimension, and the other having improved esthetic qualities but which is not possible to dismantle or with great difficulties.

It is an object of the present invention to overcome these drawbacks and to propose a device for fixing and maintaining stretched a panel of supple material, presenting reduced dimensions and visible parts of reduced size, and also being easily dismantled without being detrimental to the ease of positioning.

To that end, according to the invention, the device for fixing on a support, such as an original ceiling, and stretch by its edges a panel of supple material (constituting a stretched ceiling), of the type comprising a section capable of being fixed on said support, and associated with means for blocking by effect of pinching of the edge of the panel, is characterized in tat it comprises means for removably connecting on said section an element whose distal end, towards the edge of the panel, is provided with said pinching means.

According to an advantageous embodiment, said element is of quadrangular section (in a pane perpendicular to the plane of the panel) and whose large length is parallel to the panel, the section comprising a first plane part of small thickness and a second, more massive terminal part on the side opposite the edge of the panel, the element and the section being of complementary dimension and shape, so that the section/element assembly is of general quadrangular section.

The means for connecting the element on the section comprise clipping means, for example disposed towards one end of the section of the element of the body of the edge, the other end of the element being mounted to rotate in a housing in the section. The end of the element and the corresponding housing provided in the massive part of the section, are advantageously generally rounded in shape (for example in the form of an arc of circle, seen in cross-section).

A stop for blocking in rotation is advantageously disposed on the spherical end of the element.

The means for clipping the element on the section are advantageously inclined in two opposite directions.

Finally, the section may comprises recesses intended for members for fixing the section on said support. Likewise, the pinching means comprise a lip associated with a housing, deformable between a spaced apart position where the edge of the panel may be introduced in the housing and a folded down position where said lip bears against the edge of said housing and thus pinches the edge of the panel.

The section and the element are advantageously made of transparent plastics material.

The invention will be more readily understood on reading the following description in which:

FIG. 1 schematically shows a view in perspective of premises, on the ceiling of which is disposed a ceiling stretched with the aid of the device according to the invention.

Figure 2:
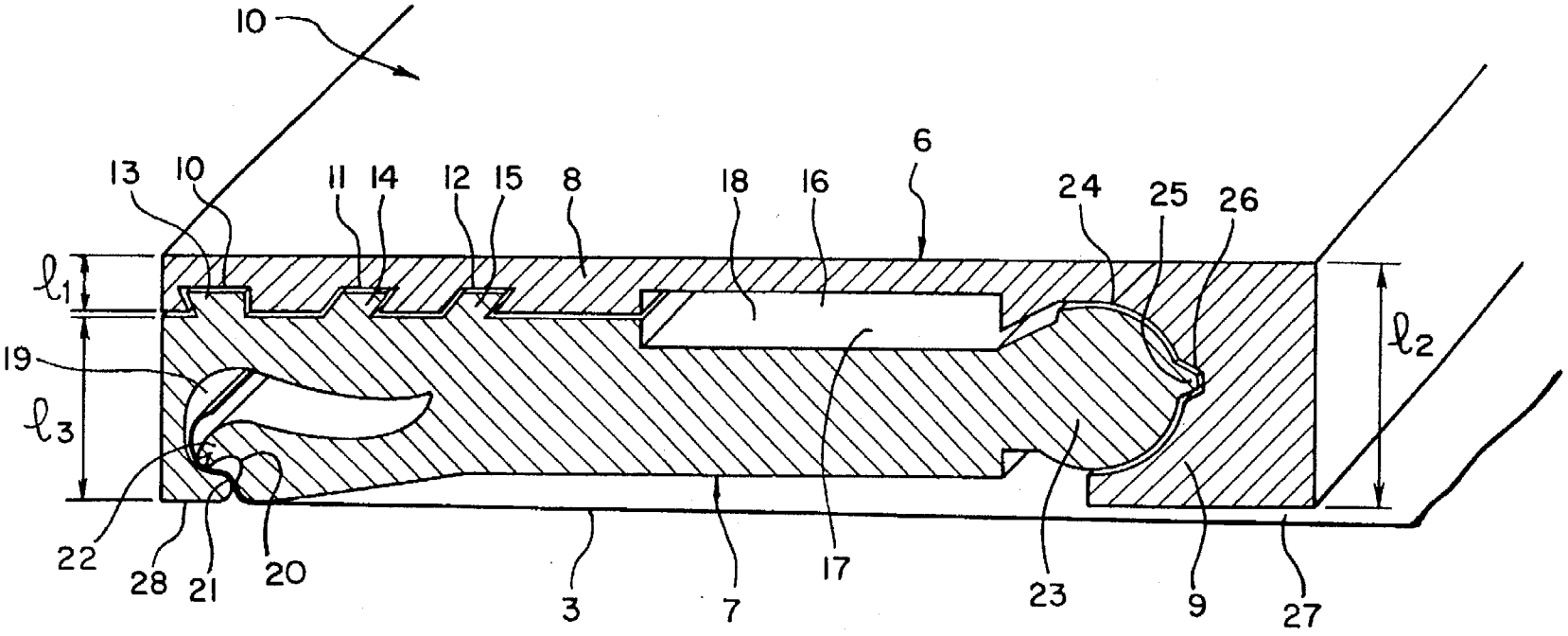

FIG. 2 shows a view in perspective and in transverse section of the device of the invention.

FIG. 1 very schematically shows premises 1 provided with a ceiling 2 on which is placed and stretched a false ceiling or stretched ceiling 3 in the form of a sheet of synthetic material. The fixing and stretching device of the invention is constituted, for each of the edges of the stretched ceiling, by a section 4 associated with an elongated element 5, capable of blocking the stretched ceiling 2 by pinching. The section 4 is rendered fast with the original ceiling 2 by any appropriate means, such as glueing, clipping or nailing. To render the drawing clear, only one of the edges of the stretched ceiling 3 is shown associated with the device of the invention, which will be described hereinafter in greater detail with reference to FIG. 2.

FIG. 2 shows that the device comprises, on the one hand, a section 6 and an elongated element 7. The length of the section 6 and of the element 7 is of the order of one of the dimensions of the ceiling, for example some meters.

Seen in transverse section, section 6 is generally of quadrangular shape and comprises a substantially plane part 8 of small thickness, and a part 9 thicker than the first part 8. The plane part 8 defines an upper plane 10 which may be applied against the original ceiling which is to be concealed. For example, in height $1_1$ of the plane part 8 of the section 6 is preferably less than 3 mm, for example equal to 2 mm, while the height $1_2$ of the second part 9 of the section 6 is preferably less than 11 mm, for example of the order of 7.5 mm.

Seen in transverse section, element 7 is of generally quadrangular shape, and of shape and dimensions substantially complementary of said section, so that, once said element 7 is connected to said section 6, the section/element assembly presents a generally quadrangular shape seen in cross-section.

The means for connecting the element of the section comprises clipping means constituted in the present case by a first set of grooves 10 and a second set of grooves 11 and 12 provided on the face of the part 8 of the section 6 opposite the original ceiling, i.e. on the side opposite the surface 10 mentioned above. The element 7 comprises a first set of tenons 13 projecting with respect to the plane of the element and associated with the groove 10, and a second set of tenons 14 and 15 likewise projecting with respect to the pane of the element 7 and associated with the second set of grooves 11 and 12. It should be noted that the first set of tenons and grooves 13, 10 and the second set of tenons 14, 15 and grooves 11, 12 are preferably disposed so as to allow a clipping of the element 7 on the section 6, in opposite inclined directions.

Section 6 comprises a recess of generally quadrangular shape bearing reference 16 opposite which a recess 17 is arranged on element 7. Recesses 16 and 17 form, once the element 7 is in place, a sort of elongated quadrangular cavity, substantially parallel to the ceiling (plane 10). This cavity 18 is intended to receive the projecting part of fixing elements, such as screw, nail or clip, intended to fix the section 6 on the original ceiling (ceiling 2 in FIG. 1).

The distal end of the element 7, on the side opposite the massive part 9 of the section 6, is provided with means for blocking the stretched ceiling 3 by pinching. The pinching means are constituted by a housing 19 and a lip 20 capable of being spaced apart, to allow passage of the edge of the stretched ceiling 3. The lip may then be returned into original position where it bars by its end against the edge 21 of the housing 19 provided in the element 7. In this way, the ceiling 3 is blocked by a pinching phenomenon. In order to reinforce this pinching, an auxiliary lip 22 is provided at the end of the lip 20.

The other end of the element 7, opposite the edge of the stretched ceiling 3, presents a generally rounded shape (arcuate), seen in cross-section, of shape complementary to the housing 24 provided on the massive part 9 of the section 6. The spherical end 23 and the spherical housing 24 thus form a system of articulation of the element 7 on the section 6, along an axis parallel to the edge of the stretched ceiling 3. A cam-forming member 25 projects with respect to the surface of the rounded end 23, and is capable of being housed, once the element 7 is in place, in a complementary groove 26 provided on the massive part 9 of the section 6.

The height of the element 7, once it has been positioned on the section 6, and referenced $1_3$ in FIG. 2, is such that the sum of $1_3+1_1$ is greater than of equal to the height $1_2$ of the massive part 9 of the section 6. Once the section 6 is fixed on the ceiling 2, this makes it possible to leave a space 27 between the stretched ceiling once positioned and the massive part 9 of the section 6. $1_3$ is preferably less than 8 mm and, for example, equal to 6 mm.

The device of the invention is placed in position in the following manner.

In a first step, the section 6 is fixed on the ceiling 2 so that the surface 10 of the section 6 bears against the ceiling 2. The section 6 may be fixed by nailing, glueing or clipping or any other adequate means. The fixing means such as clip or nail are provided at right angles to the recess 16 provided on the section 6.

In a second step, element 7 is introduced by its rounded end 23 in the complementary rounded cavity 24 provided on section 6 so that the cam 25 penetrates at the end of rotation in the groove 26 (provided in the massive part 9). The edge of the panel of supple material, intended to constitute the stretched ceiling 3, is then introduced in housing 19 of element 7, the lip 20 and the auxiliary lip 22 being previously moved apart, then these latter are returned, by their own elasticity for example, to their position of blockage where they bear against the edge 21 of housing 19 and thus blocks by pinching the edge of panel 3 made of supple material. This later is introduced in housing 19 by an adequate length as a function of the measurements previously made and of the desired tension.

Then, by pressing on the end of element 7 (towards the edge of the supple panel), element 7 is connected by clipping on the section 6, by reciprocal engagement of the tenons 13 in the groove 10 and the tenons 14 and 15 in the grooves 11 and 12. It should be noted that the first set of tenons and grooves 13, 10 is bevelled in a direction opposite the directions of the bevelled planes of the second set of tenons 14, 15 associated with grooves 11 and 12.

The stretched ceiling 3 exerts a force of tension on the element 7 towards the right in FIG. 2, which tends to push the element 7 still further inside the rounded cavity 24 provided on the massive part 9 of the section, and therefore tends to maintain the element 7 in place on the section 6. Similarly, the inclined direction of the bevels formed by the tenons 11 and 12 and the associated grooves 14 and 15, goes in the same direction and therefore tends to reinforce the connection, under the effect of the force of tension coming from the stretched ceiling 3, between the element 7 and the section 6. The opposite direction of the bevel formed by the first set of tenons 13 and the associated groove 10 allows hold in position and prevents the element 7 from tearing away from the section 6, in a descending vertical direction, transversely to the plane of the stretched ceiling 3.

The panel of supple material is dismantled as follows:

A flat-edged tool is engaged between the section 6 and the element 7 (towards the edge of the supple panel), by downward lever effect; the tenon 13 is disengaged from the groove 10 by deflection. Then, the lever effect is continued downwardly, pivoting the rounded end 23 in the cavity 24 thus disengaging the cam 25 from its housing 26, which makes it possible for the element 7, when it rotates on its axis 23, to move laterally thanks to its cam 25 (exerting a pressure contrary to the pressure of the stretched supple panel) on the rounded cavity 24, thus releasing the tenons 14 and 15 from their housings 10 and 11. At the end of stroke, the rounded end 23 is extracted from cavity 24, releasing the ceiling of supple panel still maintained and fast with element 7.

Section 6 and element 7 may be made of any appropriate material capable of being produced by extrusion of moulding. The section b may be made of metal (aluminum) or any other rigid or semi-rigid plastic material. The element 7 will be made of rigid or semi-rigid plastic material such as for example PVC.

Element 7 is preferably made of a transparent synthetic material in order to reduce further the visible part, by optical effect, of the device. Similarly, the element 7 is made of a material of preferably slight rigidity, in order to be able to be slightly deformed during removal and positioning.

It will be noted that the device of the invention presents an extremely reduced visible part (referenced 28 in FIG. 2). Likewise, it is extremely easy to dismantle and position the stretched ceiling 3 on the element 7 and position and dismantle the element 7 with respect to the section 6, without reliability being affected.

The invention is not limited to the embodiment described and shown but covers any varient such as mentioned in the accompanying claims.

I claim:

1. Device for fixing on a support (2) such as a ceiling and stretching by its edges a panel (3) of supple material, of the type comprising:

an elongate section (6) having opposing distal and proximal lateral edges extending along the length of said section and capable of being fixed on said support (2);

a substantially elongated element (7) having opposing distal and proximal lateral edges extending along the length of said element of which said distal comprises means for blocking said panel (3) and of which said proximal edge (23) is adapted to pivotally cooperate in abutment with a first housing (24) of complementary dimension and shape provided on said section (6), the element (7) being independent of the section (6);

means for removably connecting the element (7) on said section 6, in order to maintain the element (7) in an operative sheet holding place on the section (6); characterized in that said connecting means are disposed towards said distal edges of said section and said element and are adapted to immobilize the element (7) on the section in all directions and independently of said means for blocking of the panel on the element, and in that said means for blocking the panel (3) are provided in said distal edge of said element (7), are of the pinching type and are constituted by a deformable lip (20) associated with a second housing (19), both being capable of being spaced apart, to allow passage of the edge of the panel (3) in the housing (19), said lip (20) being previously moved apart and capable of returning, by its own elasticity, into its original position, where it bears, by its deformable lip, against the edge (13) of the second housing (19) and thus blocks by pinching the edge of the panel (3).

2. Device according to claim 1, characterized in that the first housing (24) presents a spherical shape, and the proximal edge of the element (7) being of complementary dimensions and shape.

3. Device according to claim 1, characterized in that said connecting means comprise clipping means (13 to 15) comprising tenon/mortise assemblies, of which a first set is bevelled in one direction and a second set is bevelled in an opposite direction.

4. Device according to claim 1, characterized in that it is made of a transparent synthetic material.

* * * * *